United States Patent [19]

Bruninga

[11] 4,164,324

[45] Aug. 14, 1979

[54] SPRINKLER HEAD WITH IMPROVED INTEGRAL IMPACT ARM AND ANTI-BACKSPLASH DRIVE SPOON

[75] Inventor: Kenneth J. Bruninga, Mapleton, Ill.

[73] Assignee: L. R. Nelson Corporation, Peoria, Ill.

[21] Appl. No.: 880,275

[22] Filed: Feb. 22, 1978

[51] Int. Cl.[2] ..... B05B 3/14

[52] U.S. Cl. ..... 239/230; 239/233; 239/511

[58] Field of Search ..... 239/230-233, 239/503, 507, 509-511, 516

[56] References Cited

U.S. PATENT DOCUMENTS

| | | | |
|---|---|---|---|
| 3,022,012 | 2/1962 | Sharp et al. | 239/230 |
| 3,070,314 | 12/1962 | Warren | 239/230 |
| 3,208,672 | 9/1965 | Sully | 239/230 |
| 3,408,009 | 10/1968 | Friedmann et al. | 239/230 |
| 3,952,953 | 4/1976 | Eby | 239/230 |
| 3,955,762 | 5/1976 | Cassimatis et al. | 239/230 |
| 3,977,610 | 8/1976 | Royer | 239/230 |

*Primary Examiner*—Robert B. Reeves
*Assistant Examiner*—Andres Kashnikow
*Attorney, Agent, or Firm*—Cushman, Darby & Cushman

[57] ABSTRACT

A part-circle step-by-step rotary sprinkler head having an improved anti-backsplash drive spoon integrally formed as a part of the impact arm and having a construction related to the longitudinal axis of the outlet when the arm is in its impact limiting position which comprises upper and lower walls in a position to receive the stream therebetween, an initial stream engaging wall extending between the upper and lower walls and a final stream engaging wall extending between the upper and lower walls spaced with respect to the initial stream engaging wall in a position (1) with all portions thereof disposed outwardly of all portions of the initial wall in a transverse direction corresponding to the direction of movement of the spoon away from its impact position, (2) with a longitudinally inward portion thereof disposed in longitudinally lapped relation with a longitudinally outward portion of the initial wall and (3) with a longitudinally outward portion thereof disposed longitudinally outwardly of the longitudinally outward portion of the initial wall. The reactant water contacting surface of the final wall is disposed substantially entirely transversely outwardly of a plane passing through the leading edges of the initial and final walls.

10 Claims, 8 Drawing Figures

SPRINKLER HEAD WITH IMPROVED INTEGRAL IMPACT ARM AND ANTI-BACKSPLASH DRIVE SPOON

This invention relates to water sprinklers and more particularly to improvements in part-circle, step-by-step rotary sprinkler heads.

Step-by-step roatry sprinkler heads of the impact type are generally recognized to be one of the most efficient devices for distributing a given water supply onto a given area to be sprinkled. Sprinkler heads of this type have the ability of directing a supply of water in a stream in a generally upwardly and outwardly direction at a most advantageous projection angle so as to insure that the water will be distributed to the area to be sprinkled at a maximum distance from the discharge or outlet orifice of the sprinkler head. Such maximum distance can only be achieved where the turning movement of the sprinkler head is relatively slow. This slow relative speed is obtained by the operation of the impact arm. In the usual sprinkler head of this type the impact arm is mounted for oscillating movement about an upright vertical axis and includes a drive spoon which in an impact limiting position is disposed in a position to be engaged by the stream issuing from the outlet nozzle. The drive spoon includes an initial pull-in surface which engages the stream and by virtue of such engagement creates a reaction component in a direction to move the drive spoon further into the stream. When the impact arm reaches the limiting position with the drive spoon in the stream, the arm impacts the rotatable sprinkler body so as to impart the arcuate movement to the sprinkler body mounted upright on the pivotal axis. The extent of the arcuate movement is determined by a brake assembly acting between the stationary housing assembly of the sprinkler head and the rotatable sprinkler body.

The initial pull-in surface of the drive spoon serves to direct the stream engaging the same onto a spaced reactant surface which establishes a reactant force outwardly of the axis having a tangential component capable of effecting movement of the impact arm in a direction away from the limiting position. As the impulse arm moves away, a spring acting between the impact arm and the sprinkler body serves to retard the movement and effect a return movement of the impact arm. In this way, the aforesaid relatively slow arcuate movement is automatically cyclically imparted to the sprinkler body. Moreover, the operation of the impact arm further serves to break up the stream and provide the sprinkler head with an elliptical pattern rather than a doughnut-shaped pattern.

As is well known in the art, a conventional impact sprinkler head distributes the water by virtue of engagement of the stream with the drive spoon onto the ground around the axis of rotation of the sprinkler body in such a manner that the projection of the water intercepted by the drive spoon is transversely forwardly of the direction of upward and outward projection of the main stream. Where the sprinkler head is a full circle sprinkler head, this out-of-phase direction of the main stream and spoon diverted water is of no consequence, since the circular patterns are ultimately blended together. However, as is well known, this out-of-phase relationship between the drive spoon diverted water and the main stream water becomes a problem when the sprinkler head is operated in a part-circle mode.

This problem has long been recognized and one manner of dealing with the problem is disclosed in U.S. Pat. No. 3,022,012. This patent discloses the formation of the drive spoon into an S-shaped configuration utilizing a generally tubular construction. The advantage of the arrangement of the patent is that the direction of discharge of the water diverted by the drive spoon is parallel with the direction of projection of the main stream rather than laterally forward. This in effect places both the water diverted by the drive spoon and the water in the main stream in sector phase with one another so that there is no overlap from a desired segmental pattern such as a quarter-circle or a half-circle pattern. The need for such in-phase operation is particularly desirable in sprinkler systems where part-circle patterns are used to direct the water away from sidewalks and other areas where there should be no water distributed.

While the arrangement as disclosed in U.S. Pat. No. 3,022,012 constitutes an effective way of dealing with the overlap or out-of-phase problem described above, improvements in the performance and economics of construction are always desirable. For example, the S-shaped drive spoon construction of the patent is disclosed as being formed of a tube bent into an S-shaped configuration. The provision of a separate tube which must be fixedly attached to the arm materially increases the costs involved. This same consideration applies to the modified trough construction of FIG. 6 as well. Other composite constructions are disclosed in U.S. Pat. Nos. 3,208,672 and 3,952,953. The actual composite construction manufactured and sold by the owners of U.S. Pat. No. 3,022,012 consisted of welding or brazing a bent copper tube in a position with respect to the conventional pull-in surface of a conventional spoon in an arrangement similar to that shown in U.S. Pat. No. 3,208,672 except that the conventional reaction surface of the spoon is eliminated rather than retained as in U.S. Pat. No. 3,208,672.

It has been recognized that a decided economical improvement over these composite constructions could be achieved if the functions of the composite S-shaped spoon could be formed integrally as a part of the arm when the arm is made. Such a consideration involves both the ability to mold the arm and spoon of a plastic material utilizing known plastic molding techniques as well as the ability to cast the arm and spoon of a metallic material in accordance with known metal casting techniques.

Proposals of one-piece arm and spoon constructions are disclosed in U.S. Pat. Nos. 3,408,009; 3,955,762 and 3,977,610. The construction disclosed in the first two of these patents suffers from two disadvantages. First, because the initial and final walls of the spoon overlap transversely and longitudinally there is presented a coring problem in the metal casting construction shown which would likewise be presented in plastic molding techniques as well. Second, the construction has failed to properly consider the initial effect which takes place during the initial engagement of the spoon with the stream. In all of the patented constructions the part of the spoon which initially contacts the stream is a sharp edge. The pull-in surface which extends from this sharp edge does not immediately receive water from the stream. Rather, the action is one in which the edge serves to divert a wisp or layer of water from the stream which initially extends transversely outwardly in the direction in which the spoon moves away from its limiting position. This layer of water which is stripped off by the leading edge of the spoon moves progressively transversely inwardly until it contacts the pull-in surface of the spoon.

In each of the two structures noted above (U.S. Pat. Nos. 3,408,009 and 3,955,762) the layer of water which is stripped by initial engagement of the leading edge when initially directed transversely outwardly contacts the reactant surface, thus diminishing the effectiveness of the initial pull-in portion of the spoon and rendering the spoon incapable of effective operation over a wide range of capacities. The last patent (U.S. Pat. No. 3,977,610) of the three mentioned above which provide integral drive spoons of the type herein contemplated, obviates the first disadvantage of the first two patents by spacing the final portion of the spoon transversely outwardly from the initial portion so that the central portion of the spoon is open and presents no coring problems. However, the arrangement of the last patent does not obviate the second disadvantage and indeed, it is possible to move a spoon constructed in accordance with this patent into a position of equilibrium within the stream. Such a position constitutes a position of partial entry into the stream wherein the initial layer of water peeled off or diverted by the leading edge of the spoon is directed directly onto the reactant surface without the spoon moving further inward into a position enabling the stream to fully engage the pull-in surface. In this position, the reactant force acting on the leading edge tending to move the spoon in is balanced by the reactant force of the diverted layer of water acting on the final reactant surface of the spoon.

With the above in mind, it is an object of the present invention to provide a drive spoon construction of the type described which will achieve all of the advantages noted above with respect to the prior art while eliminating the disadvantages thereof. In accordance with the principles of the present invention this objective is obtained by forming the spoon integrally with the arm with a construction related to the longitudinal axis of a sprinkler body outlet when the arm is in its impact limiting position which includes upper and lower walls disposed in a position to receive the stream issuing from the outlet therebetween. The final stream engaging wall extending between the upper and lower walls is spaced with respect to the initial stream engaging wall between the upper and lower walls in a position (1) with all portions thereof disposed outwardly of all portions of the initial wall in a transverse direction corresponding to the direction of movement of the spoon away from its impact position, (2) with a longitudinally inward portion thereof disposed in longitudinally lapped relation with a longitudinally outward portion of the initial wall and (3) with a longitudinally outward portion thereof disposed longitudinally outwardly of the longitudinally outward portion of said initial wall. Moreover, the reactant water contacting surface of the final wall is disposed substantially entirely transversely outwardly of a plane passing through the leading edges of the initial and final walls. In this way, the core difficulties heretofore encountered are obviated while at the same time eliminating the disadvantages heretofore encountered relating to the impingement of the initial layer of water diverted by the leading edge of the spoon.

These and other objects of the present invention will become more apparent during the course of the following detailed description and appended claims.

The invention may best be understood with reference to the accompanying drawings, wherein an illustrative embodiment is shown.

Figure 1:
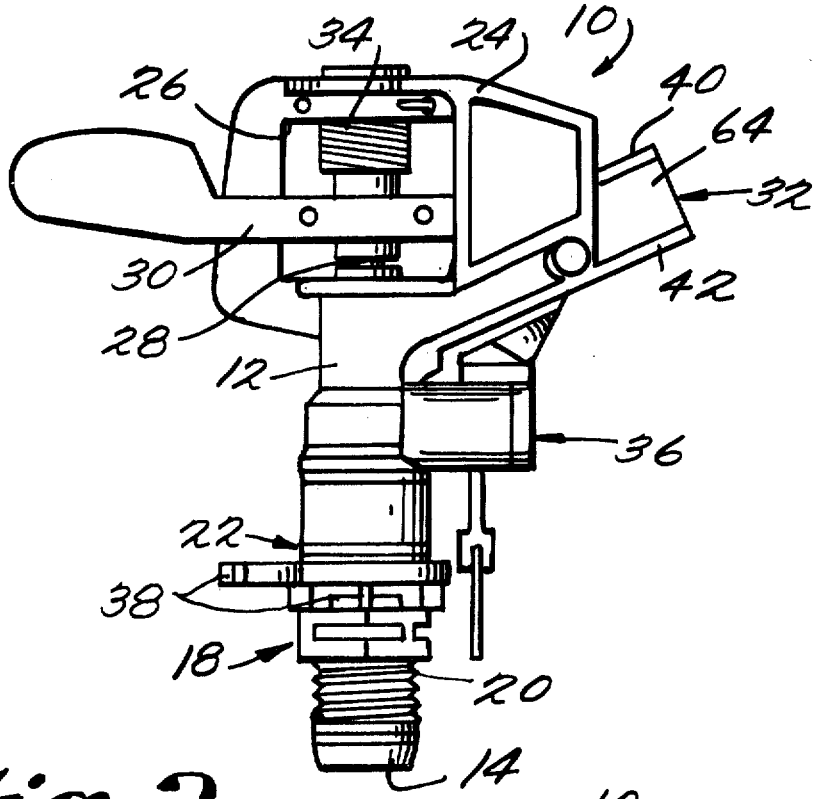
FIG. 1 is a left-hand side elevational view of a plastic part-circle step-by-step rotary sprinkler head embodying the principles of the present invention.
Figure 2:
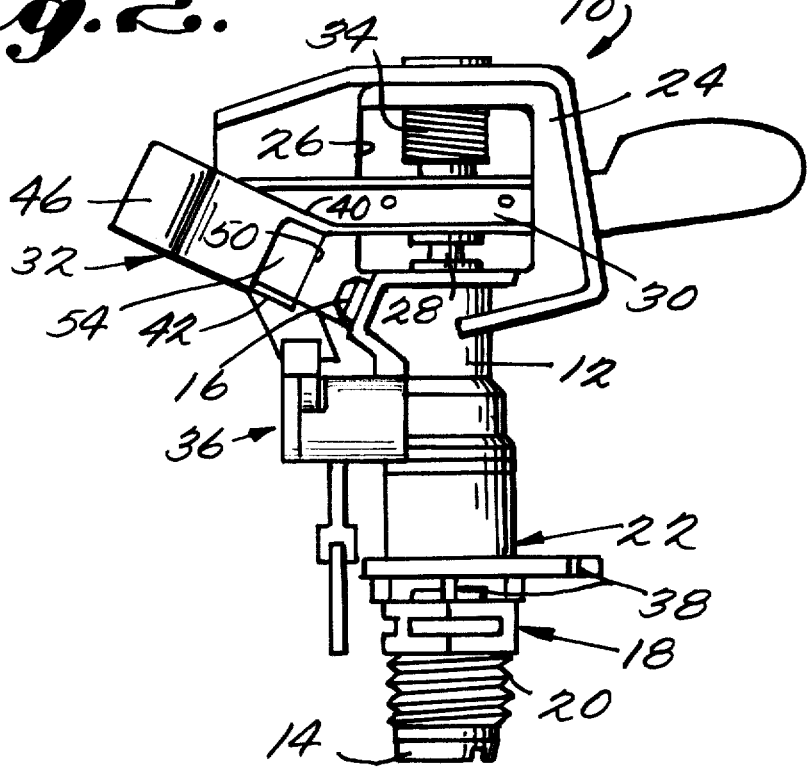
FIG. 2 is a right-hand side elevational view of the sprinkler head shown in FIG. 1.
Figure 3:
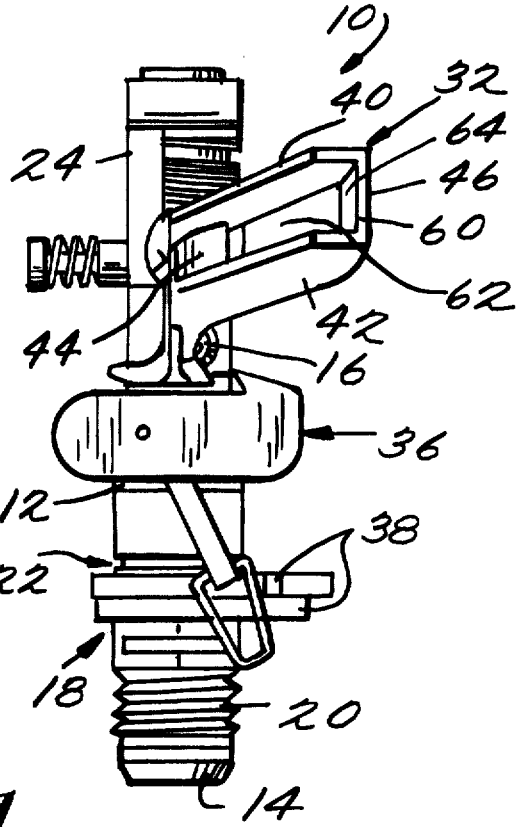
FIG. 3 is a front elevational view of the sprinkler head shown in FIG. 1.

Referring now more particularly to FIGS. 1-3 of the drawings, there is shown therein a part-circle step-by-step rotary sprinkler head, generally indicated at 10, which embodies the principles of the present invention. For purposes of illustration, the sprinkler head 10 shown in the drawings is formed of a plastic material in accordance with conventional practice. The sprinkler head includes a main sprinkler body 12 molded of a suitable plastic material. Connected with the lower portion of the sprinkler body 12 is a tubular member 14, the lower end of which constitutes an inlet for a flow passage extending upwardly through the sprinkler body 12 along a vertical axis of the lower tubular portion and then upwardly and outwardly through an outlet nozzle 16. Mounted for rotational movement about the vertical axis of the lower tubular portion 14 is a sleeve assembly 18. The lower portion of the sleeve assembly 18 has exterior threads 20 formed thereon adapted to engage the internal threads in a suitable source pipe (not shown). When the sleeve assembly 18 is connected with the source pipe by engagement of the threads 20 therewith the sprinkler body 12 is supported by the sleeve assembly 18 carried on the source pipe for rotational movement about a vertical axis. The sleeve assembly 18 has a spring pressed brake sub-assembly 22 associated therewith which serves to restrain the aforesaid rotational movement. It will also be understood that when the sprinkler head 10 is mounted on a suitable source pipe as by engagement of the threads 20 therewith and a source of water under pressure within the source pipe is communicated with the inlet 14, such water under pressure will flow upwardly through the sprinkler body 12 and then upwardly and outwardly through the outlet 16. It will be noted that the outlet 16 has a central longitudinal axis which is disposed within a vertical plane passing through the axis of rotation of the sprinkler body which intersects the vertical axis within such plane at an angle of approximately 25°.

The sprinkler body includes an upper portion 24 having an opening 26 formed therein. Mounted in the upper portion of the sprinkler body 12 and extending through the opening 26 is a shaft 28 having its axis aligned with the vertical axis of rotation of the sprinkler body 12. Mounted on the shaft 28 for oscillatory pivotal movement is an impact arm 30. Formed integrally on one end of the arm 30 is a drive spoon, generally indicated by the numeral 32, which is constructed in accordance with the principles of the present invention. The impact arm 30 is normally biased into an impact limiting position as shown in FIGS. 1–3 wherein the portions of the arm adjacent the shaft 28 engage the upper portion 24 of the sprinkler body on opposite sides of the opening 26. As shown the bias is provided by a coil spring 34 surrounding the upper end of the shaft 28 and having one end connected with the upper portion of the sprinkler body and the other end thereof connected to the impact arm 30.

The drive spoon 32 is operable to be engaged by the stream when in its impact limiting position and to impart a rotary movement to the arm 30 by virtue of the reaction of the water on the spoon in a direction to move the spoon away from the stream. As the arm rotates in a direction to move the spoon away from the stream, spring 34 retards its movement until it is completely stopped and resiliently biased thereby to move in the opposite direction. In this way as the arm rotates under the action of the spring 34 and moves into its impact limiting position, the upper portion 24 of the sprinkler body is impacted causing the sprinkler body 12 to move about its vertical pivotal axis under the restraint of spring brake 22. Thus, in accordance with usual practice, the impact arm and drive spoon will normally serve to effect a step-by-step rotational movement of the sprinkler body in one direction.

The sprinkler head 10 is provided with a reversing mechanism, generally indicated at 36, which is adapted to cooperate with the impact arm 30 and a pair of adjustable stops 38. The details of construction of the reversing mechanism and its exact mode of operation form no part of the present invention. An exemplary embodiment similar to the illustrative mechanism shown is disclosed in detail in U.S. Pat. No. 3,070,314, the disclosure of which is hereby incorporated by reference into the present specification. For present purposes, it is sufficient to note that in one position, the reversing mechanism is operable to permit the impact art and drive spoon to function normally to effect a normal step-by-step rotational movement of the sprinkler body. When the sprinkler body reaches a first predetermined position as determined by the position of a first one of the adjustable stops 38, the reversing mechanism 36 is moved into a second position (as shown in FIG. 3) which has the effect of causing the outward movement of the impact arm to effect a rapid step-by-step rotary movement of the sprinkler body in the opposite direction until the latter reaches a second predetermined position of rotational movement determined by the position of adjustment of the other stop wherein the reversing mechanism 36 is moved back into its other operating position.

As previously indicated, the present invention is more particularly concerned with an improved integral construction of the drive spoon 32 with the impact arm 30, the remaining components of the sprinkler head 10 may be of any desired construction. The illustrative embodiment described above is a well-known construction marketed under the trademark NELSON® by L. R. Nelson Corporation. The particular illustrative embodiment shown is a sprinkler head molded of plastic material and hence the impact arm 30 and integral drive spoon 32 are likewise molded of a plastic material. An exemplary plastic material is CELCON® or DELRIN®.

Figure 4:
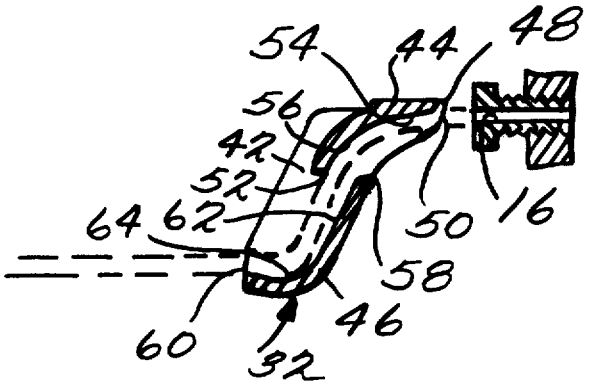
FIG. 4 is a sectional view illustrating the relationship between the outlet nozzle and drive spoon of the sprinkler head when the drive spoon is in its impact limiting position.
Figure 5:
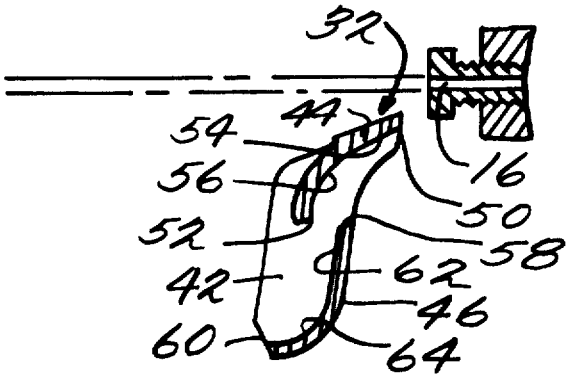
FIG. 5 is a view similar to FIG. 4 showing the drive spoon in a position near its impact limiting position out of engagement with the stream issuing from the outlet.

For purposes of convenience and accuracy the drive spoon construction 32 of the present invention will be described in relation to the longitudinal axis of the outlet 16 of the sprinkler head with the integral impact arm 30 and drive spoon 32 disposed in its impact limiting position. Such a position is shown in FIG. 4. As shown, the drive spoon includes upper and lower walls 40 and 42 disposed in a position to receive the stream issuing from the outlet 16 therebetween. The drive spoon 32 also includes an initial stream engaging wall 44 extending between the upper and lower walls 40 and 42 and a final stream engaging wall 46 extending between the upper and lower walls 40 and 42. It will be noted from FIG. 4 that the final stream engaging wall 46 is spaced with respect to the initial stream engaging wall in a position with all portions thereof disposed outwardly of all portions of the initial wall 44 in a transverse direction corresponding to the direction of movement of the drive spoon 32 away from the impact position as shown in FIG. 4. It will also be noted that the interrelationship between the initial wall 44 and final wall 46 is such that a longitudinally inward portion of the final wall 46 is disposed in longitudinally lapped relation with a longitudinally outward portion of the initial wall. Moreover, the relationship is such that a longitudinally outward portion of the final wall 46 is disposed longitudinally outwardly of the longitudinally outward portion of the initial wall 44.

The initial stream engaging wall 44 provides a leading edge portion disposed at an angle of approximately 60° with respect to the longitudinal, the leading edge portion including a laterally inward leading edge 48 and a laterally outward leading edge 50. The initial wall 44 also includes an initial terminal edge 52 which is spaced longitudinally and transversely outwardly from the leading edge 50. Extending between the leading edge 50 and terminal edge 52 is a pull-in water contacting surface including an initial stream receiving portion 54 extending generally longitudinally outwardly from the leading edge 50 with a slight transversely outward extent and a transversely outwardly directing stream portion 56 extending from the initial stream receiving portion 54 in a generally concavely arcuate configuration. As shown, the stream receiving surface portion 54 is flat and is disposed at an angle of of approximately 12° with respect to the longitudinal axis. The outwardly directing stream surface portion 56 is arcuate about a fixed axis and extends through an arcuate extent of approximately 68° from its tangential juncture with the flat initial stream engaging surface portion 54. A short terminal section of the surface portion 56 extends tangentially from the arcuate at an angle of approximately 80° with respect to the longitudinal axis.

The final wall 46 includes a final leading edge 58 which is disposed longitudinally between the initial leading and terminal edges 50 and 52 and transversely outwardly from the initial leading edge 50 a distance at least as great as the distance the initial terminal edge 52 is spaced transversely outwardly from the initial leading edge 50. As shown, the transverse spacing of the final leading edge 58 is slightly greater than the transverse spacing of the initial terminal edge 52. The final wall 46 also includes a final terminal edge 60 which is spaced longitudinally and transversely outwardly from the final leading edge 58 and a reactant water contacting surface which extends between the final leading and terminal edges 58 and 60. The reactant surface includes a final stream engaging portion 62 extending generally transversely outwardly from the final leading edge 58 with a slightly longitudinally outward extent and a longitudinally outwardly directing stream portion 64 extending from the final stream receiving portion 62 in a generally concavely arcuate configuration. As shown, the final stream receiving surface portion 62 is preferably of flat configuration and disposed at an angle of 65° with respect to the longitudinal axis. As before, the outwardly directing stream portion is preferably arcuate about a single axis and has an arcuate extent of approximately 80°, the juncture of the portion 64 with the portion 62 being tangential along a line which intersects with a plane coinciding with and extending from the final angular flat surface section of the surface portion 56. The terminal section of the final surface portion may be flat and extends tangentially at an angle of approximately 15° with respect to the longitudinal axis.

In the normal operation of the drive spoon 32, as the transversely inward leading edge 48 thereof engages the stream a layer is diverted or stripped from the stream. Initially this layer is diverted transversely outwardly and as the movement of the leading edge 48 continues into the stream of thickness of the layer progressively increases and the transversely outward angle thereof progressively decreases until the layer contacts the initial stream engaging portion 54 of the pull-in surface. It will be noted that as the diverted layer moves from its initial transversely outwardly diverted direction to its direction of contact with the surface portion 54, the position of the final wall 46 is such as to prevent the diverted layer of water from directly engaging the reactant surface including portions 62 and 64. Instead, the layer will contact the back surface of final wall 46 in a manner which aids in causing the drive spoon to move further inwardly into the stream. In this regard, it should be noted that the entire reactant water contacting surface of the final wall 46 including portions 62 and 64 is disposed substantially entirely transversely outwardly of a plane passing through the leading edge 50 of the initial wall 44 and the leading edge 58 of the final wall 46.

As soon as the stream contacts the pull-in surface, a reactant force is established which serves to pull the drive spoon further into the stream toward its impact limiting position. The water flowing over the initial portion 54 of the pull-in surface then passes onto the concavely arcuate outwardly directing stream portion 56 which serves to direct the stream in a generally transversely outwardly direction toward the reactant surface of the final wall 46. The position of engagement of the stream onto the final wall is generally in the vicinity of the juncture between the surface portions 62 and 64. In this way, the stream is received on the final wall and directed longitudinally outwardly in a direction generally parallel with the longitudinal axis of the outlet, thus creating a reaction force in a transversely outward direction which acts through a greater lever arm than the lever arm through which the transversely inwardly directed reactant force on the pull-in surface acts. Consequently, there is a greater torque tending to move the impact arm in a direction in which the drive spoon moves away from the stream. It will be understood that the arrangement above described not only obviates the problems heretofore noted with respect to the interaction of the initial peeled-off layer of the stream but the transversely non-overlapping relationship between the initial and final walls also enables the drive spoon configuration to be formed simply with conventional molding equipment.

Figure 6:
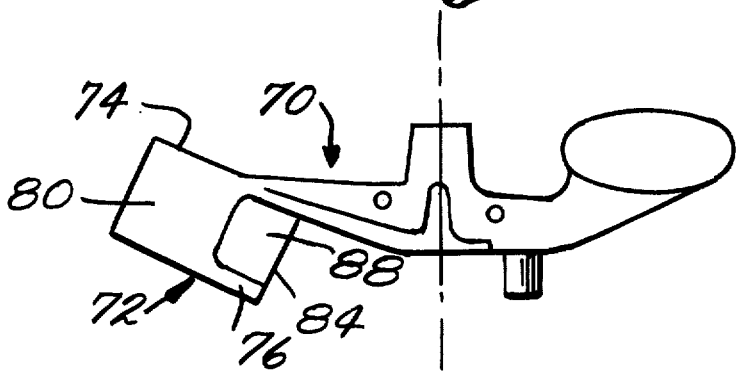
FIG. 6 is a side elevational view of an impact arm and drive spoon of brass embodying the principles of the present invention.
Figure 7:
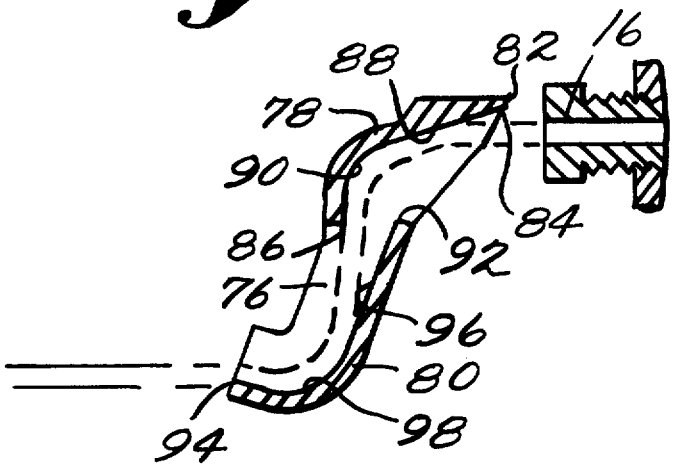
FIG. 7 is a view similar to FIG. 4 illustrating the drive spoon of FIG. 6.
Figure 8:
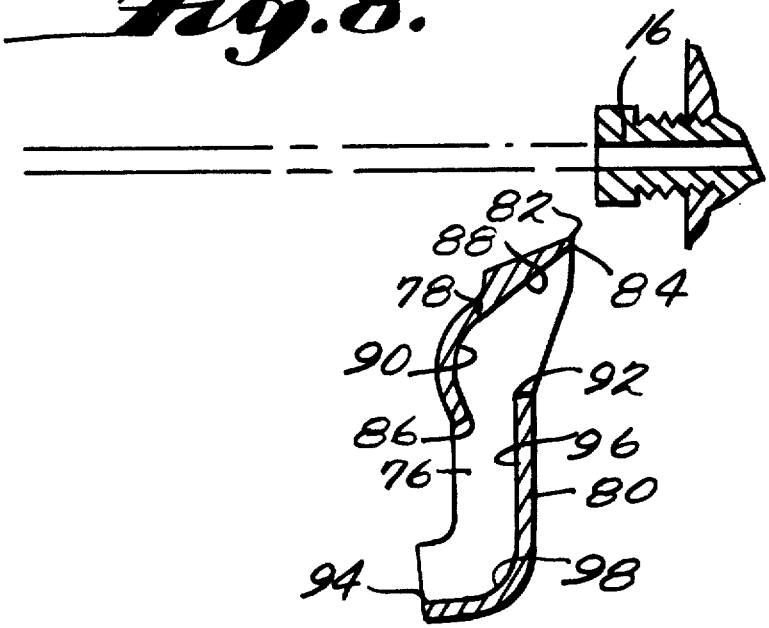
FIG. 8 is a view similar to FIG. 5 illustrating the drive spoon of FIG. 6.

FIGS. 6–8 illustrate the construction of a brass one-piece impact arm and drive spoon, generally indicated at 70. The arm 70 is cast of brass and is of generally conventional shape except insofar as the drive spoon thereof, which is generally indicated by the reference numeral 72. The drive spoon is constructed similarly to the drive spoon 32 previously described and includes upper and lower walls 74 and 76. As before, mounted between the upper and lower walls 74 and 76 is an initial stream engaging wall 78 and a spaced final stream engaging wall 80. The spaced portion of the final wall 80 with respect to the initial wall 78 contains the same three relationships previously indicated as follows: (1) all portions of the final wall 80 are disposed outwardly of the portions of the initial wall in a transverse direction corresponding to the direction of movement of the spoon away from the impact position; (2) a longitudinally inward portion of the final wall is disposed in longitudinally lapped relation with a longitudinally outward portion of the initial wall; and (3) a longitudinally outward portion of the final wall is disposed longitudinally outwardly of the longitudinally outward portion of the initial wall. The construction of the drive spoon 72 includes all of the basic component edges and surfaces of the drive spoon 32 but differs slightly therefrom to accommodate the different fabrication procedures.

The leading edge portion of the drive spoon extends at an angle of 60° with respect to the longitudinal and includes a transversely inward leading edge 82 and a transversely outward leading edge 84. The initial wall 78 also includes a terminal edge 86 and a pull-in surface extending between the leading edge 84 and the terminal edge 86 which includes an initial stream receiving portion 88 extending generally longitudinally outwardly from the initial leading edge 84 with a slight transversely outward extent and a transversely outwardly directing stream portion 90 extending from the initial stream receiving portion 88 in a generally concavely arcuate configuration. Again, the initial stream receiving surface portion 88 is preferably flat and extends at an angle with respect to the longitudinal axis of approximately 15°. The transversely outwardly directing stream portion 90 has an arcuate extent of approximately 75° and has a tangential juncture with the surface portion 88 and a short generally straight terminal section extending tangentially from the free end thereof at an angle of 90° with respect to the longitudinal.

The final wall includes a leading edge 92 which is disposed longitudinally between the leading edge 84 and terminal edge 86 and transversely outwardly from the leading edge 84 a distance at least as great as the distance the initial terminal edge 84 is transversely outwardly spaced from the initial terminal edge 86. As shown, the spacing is generally equal. The final wall 80 also includes a final terminal edge 94 which is spaced longitudinally and transversely outwardly from the final leading edge 92. A reactant water contacting surface extends between the final leading and terminal edges 92 and 94 and includes a final stream receiving portion 96 which extends generally transversely outwardly from the final leading edge 92 with a slight longitudinally outward extent and a longitudinally outwardly directing stream portion 98 extending from the final stream receiving portion in a generally concavely arcuate configuration. As before, the final stream receiving surface portion 96 is preferably flat and extends at an angle of approximately 70° with respect to the longitudinal axis. The arcuate surface 98 has an arcuate extent of approximately 85° with a tangential juncture with the flat surface 96 at a location generally coinciding with a plane passing through the final straight section of the transversely outwardly directing surface portion 90. The surface 98 also includes a short terminal section extending to the terminal edge 94 which is flat and extends at an angle of 15°.

As before, the reactant water contacting surface of the final wall is disposed substantially entirely transversely outwardly of a plane passing through the leading edge 84 of the initial wall 78 and the leading edge 92 of the final wall 80. The arrangement is such that both of the problems previously indicated relating to coring and control of the peeled-off layer of the stream are overcome by the cast metal construction of the spoon 82 shown in FIGS. 6–8.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A part-circle step-by-step rotary sprinkler head comprising:

a sprinkler body including an inlet and an outlet having a longitudinal axis, means adapted to be fixedly secured in communicating relation with a source of water under pressure mounting said sprinkler body for rotational movement about a generally vertical axis with the longitudinal axis of said outlet extending upwardly and outwardly at an angle with respect to the axis of rotation and said inlet in communicating relation to the source of water under pressure so that the latter will issue as a stream along the longitudinal axis of said outlet, impact arm means mounted on said sprinkler body for oscillating movement toward and away from an impact limiting position, said impact arm means having a drive spoon thereon engageable with the stream when said impact arm means is near and in said impact limiting position operable in response to the engagement of the stream therewith to move said impact arm means in a direction away from said impact limiting position and to direct the portion of the stream engaged thereby in a direction generally parallel with the longitudinal axis of said outlet, means for biasing said impact arm means in a direction toward said limiting position so as to move the same in said direction through an impact stroke following the movement of said impact arm means in the opposite direction under the operation of said drive spoon to thereby effect a step-by-step rotary movement of said sprinkler body in one direction, and means operable when said sprinkler body reaches a first predetermined position of rotational movement for causing the movement of said impact arm means in a direction away from said impact limiting position to effect a rapid step-by-step rotary movement of said sprinkler body in the opposite direction until the latter reaches a second predetermined position of rotational movement, the improvement which comprises said drive spoon being integrally formed as a part of said impact arm means and having a construction related to the longitudinal axis of said outlet when said impact arm means is in said impact limiting position which comprises upper and lower walls in a position to receive said stream therebetween, an initial stream engaging wall extending between said upper and lower walls and a final stream engaging wall extending between said upper and lower walls spaced with respect to said initial stream engaging wall in a position (1) with all portions thereof disposed outwardly of all portions of said initial wall in a transverse direction corresponding to the direction of movement of said spoon away from said impact position, (2) with a longitudinally inward portion thereof disposed in longitudinally lapped relation with a longitudinally outward portion of said initial wall and (3) with a longitudinally outward portion thereof disposed longitudinally outwardly of the longitudinally outward portion of said initial wall, said initial stream engaging wall having an initial leading edge disposed within said stream, an initial terminal edge spaced longitudinally and transversely outwardly therefrom and a pull-in water contacting surface extending between said initial leading and terminal edges including an initial stream receiving portion extending generally longitudinally outwardly from said initial leading edge with a slight transversely outward extent and a transversely outwardly directing stream portion extending from said initial stream receiving portion in a generally concavely arcuate configuration, said final wall including a final leading edge disposed longitudinally between said initial leading and terminal edges and transversely outwardly from said initial leading edge a distance at least as great as the distance said initial terminal edge is transversely outwardly spaced therefrom, a final terminal edge spaced longitudinally and transversely outwardly from said final leading edge, and a reactant water contacting surface extending between said final leading and terminal edges including a final stream receiving portion extending generally transversely outwardly from said final leading edge with a slight longitudinally outward extent and a longitudinally outwardly directing stream portion extending from said final stream receiving portion in a generally concavely arcuate configuration, the reactant water contacting surface of said final wall being disposed substantially entirely transversely outwardly of a plane passing through the leading edges of said initial and final walls.

2. The improvement as defined in claim 1 wherein said drive spoon includes a leading edge surface extending longitudinally and transversely inwardly from said initial leading edge at an angle of approximately 60° with respect to the longitudinal axis of said outlet.

3. The improvement as defined in claim 2 wherein said initial stream receiving surface portion is flat and disposed at an angle of approximately 12° to 15° with respect to the longitudinal axis of said outlet.

4. The improvement as defined in claim 3 wherein said transversely outwardly directing stream surface portion has an arcuate extent of approximately 75° to 68° which joins tangentially at one end to said initial stream receiving surface portion and tangentially at its other end to a flat terminal section extending at an angle of approximately 80° to 90° with respect to the longitudinal axis of said outlet.

5. The improvement as defined in claim 4 wherein said final stream receiving surface portion is flat and extends at an angle of approximately 65° to 70° with respect to the longitudinal axis of said outlet.

6. The improvement as defined in claim 5 wherein said longitudinally outwardly directing stream surface portion has an arcuate extent of approximately 80° to 85° which joins tangentially at one end to said final stream receiving surface portion and tangentially at its other end to a flat terminal section extending at an angle of approximately 15° with respect to the longitudinal axis of said outlet.

7. The improvement as defined in claim 1 wherein said initial stream receiving surface portion is flat and disposed at an angle of approximately 12° to 15° with respect to the longitudinal axis of said outlet.

8. The improvement as defined in claims 1 or 7 wherein said transversely outwardly directing stream surface portion has an arcuate extent of approximately 75° to 68° which joins tangentially at one end to said initial stream receiving surface portion and tangentially at its other end to a flat terminal section extending at an angle of approximately 80° to 90° with respect to the longitudinal axis of said outlet.

9. The improvement as defined in claim 1 or 7 wherein said final stream receiving surface portion is flat and extends at an angle of approximately 65° to 70° with respect to the longitudinal axis of said outlet.

10. The improvement as defined in claim 1 or 7 wherein said longitudinally outwardly directing stream surface portion has an arcuate extent of approximately 80° to 85° which joins tangentially at one end to said final stream receiving surface portion and tangentially at its other end to a flat terminal section extending at an angle of approximately 15° with respect to the longitudinal axis of said outlet.

* * * * *